United States Patent [19]

Prichard

[11] 4,032,116

[45] June 28, 1977

[54] MIXER ATTACHMENT FOR MINING VEHICLES

[75] Inventor: Evan S. Prichard, Newport Beach, Calif.

[73] Assignee: Challenge-Cook Bros., Incorporated, City of Industry, Calif.

[22] Filed: Dec. 31, 1975

[21] Appl. No.: 635,707

[52] U.S. Cl. ..... 259/69
[51] Int. Cl.[2] ..... B01F 7/02
[58] Field of Search ..... 259/68, 69, 45, 46, 259/9, 10

[56] References Cited

UNITED STATES PATENTS

| | | | |
|---|---|---|---|
| 2,706,623 | 4/1955 | Styes | 259/161 |
| 2,813,704 | 11/1957 | MacKissic | 259/45 |
| 3,251,579 | 5/1966 | Lasar | 259/46 |

*Primary Examiner*—Robert I. Smith
*Attorney, Agent, or Firm*—Lyon & Lyon

[57] ABSTRACT

A mixer attachment for reception in or substitute for the forwardly directed scoop provided on the front end of a mining vehicle, the mixer being primarily adapted for concrete which is applied to the mine walls by a companion machine, and includes a supporting means for storing the mixer in a draining position when not in use.

4 Claims, 4 Drawing Figures

MIXER ATTACHMENT FOR MINING VEHICLES

BACKGROUND

For safety reasons it is becoming an increasing practice to coat the walls of a mine with concrete, backed by reinforcing. The concrete is delivered to the mine in a fluid state then carried by conventional mining vehicles to the point of use and applied to the mine walls by compressed air. During transportation in the mine, insofar as known, no means is available to pick up the concrete ingredients and water at the well mouth, or other deliverypoint, then undertake mixing of the concrete during travel to the point of use. Instead the ingredients are separately hauled to a stationary mixing machine at the point of use.

SUMMARY

The present invention is directed to a mixer attachment or structure for inclusion in a mining vehicle to overcome the problems presently inherent in the coating of mine walls or for the casting of concrete for other purposes within a mine and is summarized in the following objects:

A primary object is to provide an embodiment of the mixer attachment which is arranged to be readily set in the conventional scoop forming a part of the mining vehicle, the mixer attachment including its own drive means connectable to the power supply available in the mining vehicle.

A further object is to provide an embodiment of the mixer attachment which is arranged to be substituted for the conventional mining scoop.

A further object is to provide a mixer attachment for use in conjunction with mining vehicles which incorporates a novelly arranged supporting means for storing the mixer attachment when not in use, the mixer attachment being manipulatable by the mining vehicle for reception by the supporting means or removable therefrom or for carrying the mixer attachment and supporting means between points of use.

DETAILED DESCRIPTION

Figure 1:
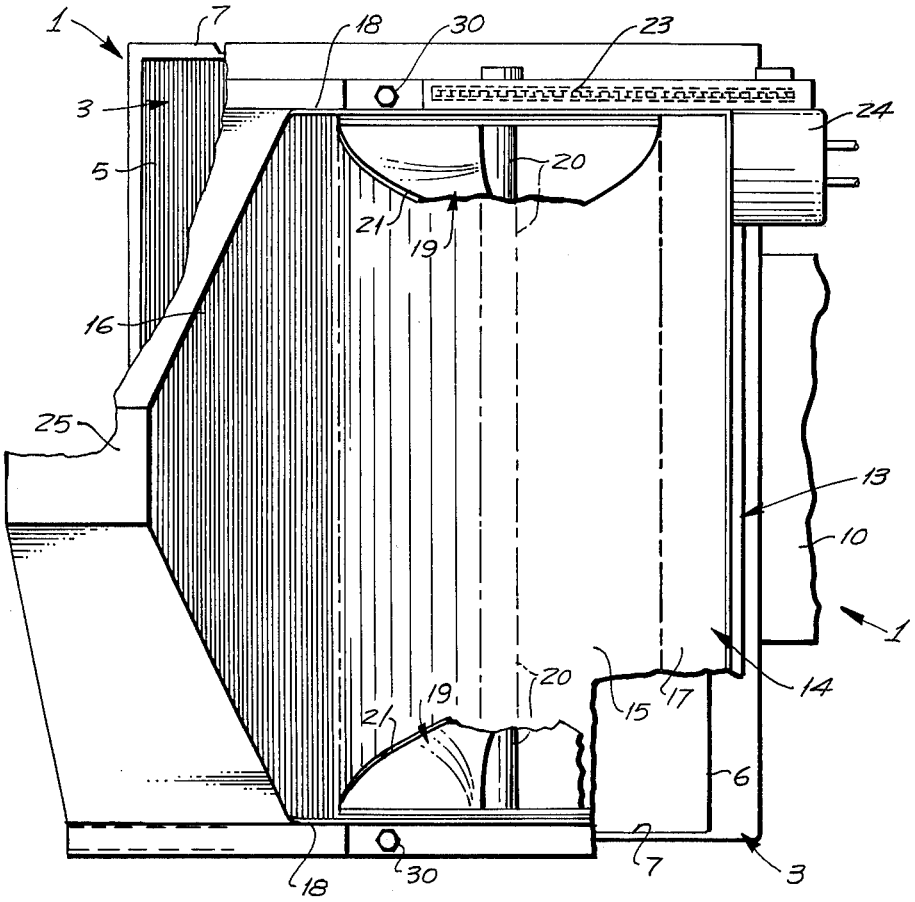
FIG. 1 is a fragmentary plan view of one embodiment of the mixer attachment, shown in position on a mining vehicle scoop, adjacent portions of the mining vehicle also being shown fragmentarily.
Figure 2:
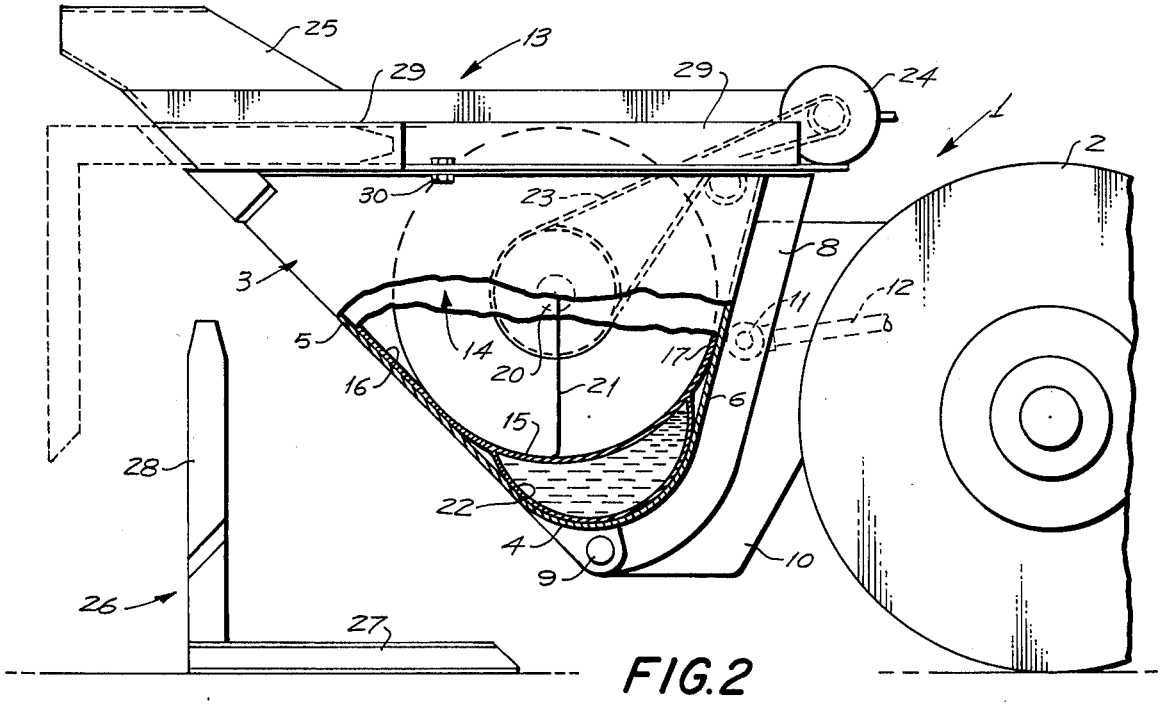
FIG. 2 is a fragmentary side view of the mining vehicle scoop and adjacent portions of the mining vehicle with portions broken away to show the mixer attachment.
Figure 3:
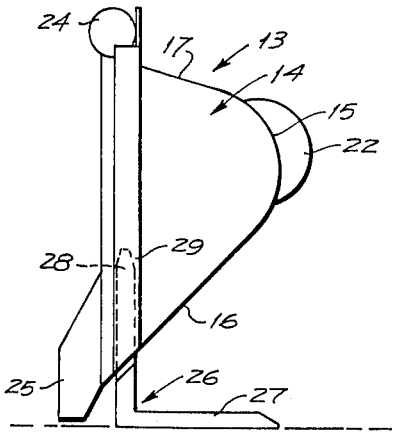
FIG. 3 is a reduced side view of the mixer attachment shown in position on a storage stand.

Referring first to FIGS. 1, 2 and 3, the mixer attachment is intended for use on a conventional mining vehicle, designated generally by 1, having forward wheels 2. A scoop 3 is located forwardly of the wheels 2. The scoop includes an essentially semi-cylindrical bottom wall 4 and upwardly diverging forward and rearward walls 5 and 6 joined to end walls 7, externally the bottom and rearward walls are provided with mounting ribs 8 the bottom portions of which are provided with an appropriate journal 9. The journal is joined to a scoop carrier lever structure 10 which extends rearwardly between the wheels 2. The rearward extremities of the lever structure, not shown, are pivotally connected to the mining vehicle chasis and their forward extremities connected to the scoop, by means of the journal 9, are caused to be raised and lowered by hydraulic power units, not shown. Connected to the ribs 8, by pivot means 11, are tilting arms 12 which are connected to or form a part of other hydraulic power units not shown, and function to tilt the scoop about the axis of the journal 9. The structure thus far described is conventional.

The embodiment of the mixer attachment or structure shown in FIGS. 1, 2 and 3 is designated generally by 13 and includes a mixer shell 14 having a semi-cylindrical bottom wall 15, upwardly diverging forward and rearward walls 16 and 17 jointed to end walls 18. The shell 14 is dimensioned to fit within the scoop 13, its forward and rearward walls conforming to and are in contiguous relation to the forward and rearward walls 5 and 6 of the scoop 3.

The shell 14 receives a mixer unit 19 comprising a horizontal shaft 20 provided with blades 21. The desired diameter of the mixer unit 19 is larger than the diameter of the curved bottom wall 4 of the scoop, so that the semi-cylindrical portion of the shell 14 clears the curved bottom wall 4 of the scoop 3. This space may accommodate a water tank 22 welded to the shell 14, the bottom portion of the shell forming a wall of the water tank 22. The water tank serves to supply water to the concrete mixer by a conventional supply line or hose, not shown.

The width of the shell 14 is less than the width of the scoop 3 so that the mixer unit shaft 20 may protrude from one end of the mixer structure and be connected to an end mounted drive 23, the drive 23 is connected to a motor 24 mounted on the rearward wall 17 at the end of the shell carrying the drive 23. The motor, which may be a hydraulic or electrical motor, is operated from a conventional power source carried by the mining vehicle and arranged for control by the mining vehicle operator.

Overlying the forward portion of the shell 14 is a discharge funnel 25.

As the mining vehicle is needed for other purposes it is desirable that the mixer structure 13 be readily attached or removed from the scoop 3. This is accomplished by use of a storage stand 26 including a horisontal frame 27 and a pair of upright mounting posts 28. When the mixer shell 14 is placed in the scoop 3 its upper portion may protrude a short distance above the scoop exposing the upper portions of the end walls 18, secured to the end walls 18 is a pair of mounting sleeves 29 extending horizontally and accessible from the front side of the mixer structure. The spacing of the mounting sleeves and the mounting posts is such that the mixer stucture 13 may be supported in a tilted position as shown in FIG. 3 to permit drainage and also to facilitate washing the mixer structure.

To install the mixer structure it is merely necessary to tilt the scoop into conformity with the mixer structure and bring the shell 14 and the scoop into registery. As the shell conforms to the scoop, minimal amount of fastening is required to secure the shell in position, for example, if the scoop and shell have appropriate confronting flanges, the scoop and mixerstructure may be secured by appropriate bolts 30, or other appropriate quickly operated fastening means may be provided. When operation of the mixer structure is completed it is merely necessary to manipulate the scoop so as to return the mixer structure 13 to the storage stand 26 at which time the mixer structure may be cleaned.

Some mining vehicles are so arranged that the scoop may be removed and other tools substituted; however, substantial time is involved.

Figure 4:
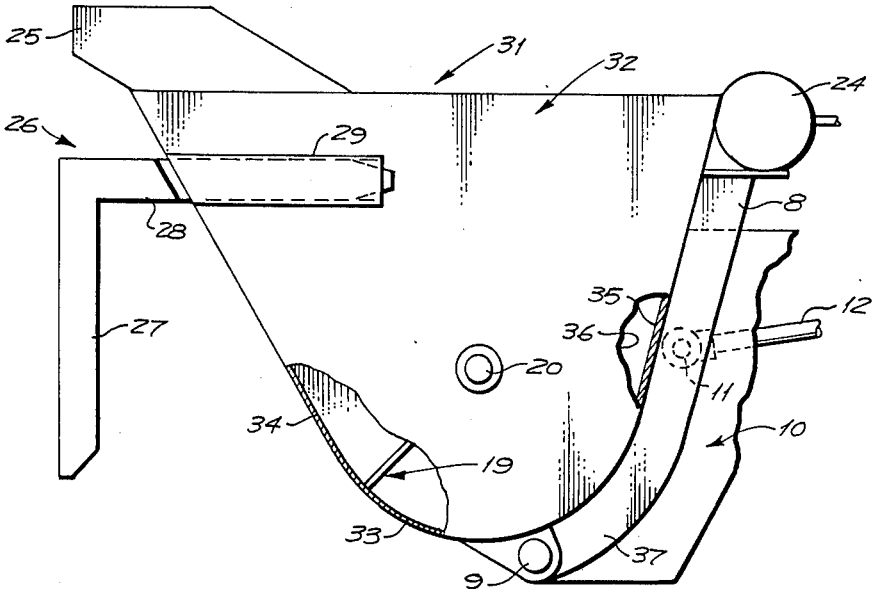
FIG. 4 is a fragmentary side view similar to FIG. 2, but showing a second embodiment of the mixer attachment wherein the mixer attachment is substituted for the mining vehicle scoop.

An embodiment of the mixer structure intended to be substituted for the scoop is shown in FIG. 4 and designated as 31. The mixer structure 31 includes a shell 32 having a semi-cylindrical bottom wall 33 upwardly diverging forward and rearward walls 34 and 35 and end walls 36. The rear wall is provided with mounting ribs 37 corresponding to the mounting ribs 8 for connection to the lever structure 10 and tilting arms 11. The shell 32 is provided with a mixer unit 19 connected to a drive operated by a motor 24, as in the first described embodiement. Also the shell 32 may be provided with mounting sleeves 29 for use with a storage stand 26, as in the case of the first embodiment.

Having fully described my invention it is to be understood that I am not to be limited to the details herein set forth, but that my invention is of the full scope of the appended claims.

I claim:

1. In combination a vehicle having a scoop defined by upwardly diverging side walls, a semi-cylindrical bottom wall and essentially parallel end walls, a forwardly directed operator manipulatable lever structure for raising and lowering the scoop, a tilting mechanism and a power supply, and a mixer structure comprising:

a. a mixer shell removably seated in said scoop and having diverging side walls conforming to the side walls of the scoop, a semi-cylindrical bottom wall confronting the bottom wall of the scoop, and end walls received between the end walls of the scoop;

b. a rotatable mixer unit within said mixer shell and overlying the bottom wall of the mixer shell contiguous thereto;

c. and a mixer drive means mounted on the mixer shell and including a motor connectable to the vehicle power supply.

2. A mixer structure as defined in claim 1 wherein:

a. a water tank is attached to the under side of the mixer shell between the bottom of the mixer shell and the bottom of the scoop.

3. A mixer structure as defined in claim 1, wherein:

a. a pouring spout extends from a side wall of the mixer shell and projects over and beyond the corresponding upper edge of the scoop.

4. A mixer structure for attachment to a vehicle having a forwardly directed operator manipulatable lever structure, a tilting mechanism and a power supply, the mixer structure comprising:

a. a mixer shell having side walls, a bottom wall, and end walls;

b. a rotatable mixer unit overlying the bottom wall contiguous thereto;

c. a mixer drive means mounted on the mixer shell and including a motor connectable to the vehicle power supply;

d. means for removably connecting the mixer shell with the lever structure and tilting mechanism to cause raising, lowering and tilting of the mixer shell to discharge material mixed therein;

e. the mixer shell includes mounting sleeves at the ends thereof;

f. and a storage frame is provided including mounting posts received in the mounting sleeves for transport by the mixer shell, when the mixer structure is carried by the mining vehicle, and for storing the mixer structure when removed from the vehicle.

* * * * *